US011578536B2

(12) United States Patent
Piipponen et al.

(10) Patent No.: US 11,578,536 B2
(45) Date of Patent: Feb. 14, 2023

(54) APPARATUS FOR FEEDING TUBE ELEMENTS, ROCK DRILLING RIG AND METHOD OF SUPPORTING DRILL HOLE OPENINGS

(71) Applicant: SANDVIK MINING AND CONSTRUCTION OY, Tampere (FI)

(72) Inventors: Juha Piipponen, Tampere (FI); Johannes Välivaara, Tampere (FI)

(73) Assignee: SANDVIK MINING and CONSTRUCTION OY, Tampere (FI)

( * ) Notice: Subject to any disclaimer, the term of this patent is extended or adjusted under 35 U.S.C. 154(b) by 386 days.

(21) Appl. No.: 16/701,749

(22) Filed: Dec. 3, 2019

(65) Prior Publication Data

US 2020/0173764 A1 Jun. 4, 2020

(30) Foreign Application Priority Data

Dec. 4, 2018 (EP) ..... 18209985

(51) Int. Cl.

| | |
|---|---|
| ***E21B 7/20*** | (2006.01) |
| ***E21B 7/02*** | (2006.01) |
| *E21C 37/00* | (2006.01) |
| *E21D 9/00* | (2006.01) |

(Continued)

(52) U.S. Cl.

CPC ..... *E21B 7/20* (2013.01); *E21B 7/025* (2013.01); *E21C 37/00* (2013.01); *E21D 9/006* (2013.01); *F42D 1/22* (2013.01); *F42D 3/04* (2013.01)

(58) Field of Classification Search

CPC ... E21C 37/00; F42D 1/22; F42D 3/04; E21D 9/006; E21D 20/003; E21D 20/006; E21B 7/025; E21B 7/20; E21B 7/205; E21B 19/22; E21B 21/015; E21B 43/10; E21B 33/04; E21B 33/14; E21B 17/20; E21B 19/14

See application file for complete search history.

(56) References Cited

U.S. PATENT DOCUMENTS

| | | | | |
|---|---|---|---|---|
| 3,861,155 A | | 1/1975 | Steinberg et al. | |
| 4,079,592 A | * | 3/1978 | Eakin | E21D 20/003 405/259.5 |
| 5,360,075 A | | 11/1994 | Gray | |

(Continued)

FOREIGN PATENT DOCUMENTS

| | | | | |
|---|---|---|---|---|
| CL | 201601779 | | 11/2015 | |
| EP | 3330482 A1 | * | 6/2018 | E21D 20/02 |

(Continued)

*Primary Examiner* — Janine M Kreck
*Assistant Examiner* — Michael A Goodwin
(74) *Attorney, Agent, or Firm* — Corinne R. Gorski

(57) ABSTRACT

An apparatus for feeding a tubular object inside a drill hole, a rock drilling rig and a method of supporting mouth openings of drill holes is provided. The apparatus includes a support device for supporting an elongated tube element blank having the potential for several successive tube inserts. A front end of the tube element blank is moved longitudinally inside a drill hole by means of a feeding device. Thereby, the drill hole is provided with a protective section extending a limited longitudinal dimension towards a bottom of the drill hole. The apparatus further includes a separation device for detaching the mentioned tube inserts one by one from the tube element blank.

15 Claims, 6 Drawing Sheets

(51) Int. Cl.
*F42D 1/22* (2006.01)
*F42D 3/04* (2006.01)

(56) References Cited

U.S. PATENT DOCUMENTS

| | | | | |
|---|---|---|---|---|
| 5,669,457 | A | 9/1997 | Sebastian et al. | |
| 5,918,677 | A | 7/1999 | Head | |
| 6,796,390 | B1 | 9/2004 | Bakker | |
| 2002/0036101 | A1 | 3/2002 | Huhdanmaki et al. | |
| 2006/0005894 | A1* | 1/2006 | Rose | F42D 3/04 138/125 |
| 2007/0056364 | A1 | 3/2007 | Uitto | |
| 2011/0182672 | A1 | 7/2011 | Nystrom | |
| 2013/0216312 | A1* | 8/2013 | Ericsson | E21B 19/146 405/154.1 |
| 2013/0228377 | A1* | 9/2013 | Kuittinen | E21B 41/00 175/57 |
| 2016/0362968 | A1* | 12/2016 | Kriesels | E21B 43/105 |
| 2020/0149854 | A1* | 5/2020 | Patching | F42D 1/08 |

FOREIGN PATENT DOCUMENTS

| | | | |
|---|---|---|---|
| WO | 2013098459 | A1 | 7/2013 |
| WO | 2014188095 | A1 | 11/2014 |
| WO | 2015128454 | A1 | 9/2015 |
| WO | 2017015727 | A1 | 2/2017 |

* cited by examiner

APPARATUS FOR FEEDING TUBE ELEMENTS, ROCK DRILLING RIG AND METHOD OF SUPPORTING DRILL HOLE OPENINGS

RELATED APPLICATION DATA

This application claims priority under 35 U.S.C. § 119 to EP Patent Application No. 18209985.3, filed on Dec. 4, 2018, which the entirety thereof is incorporated herein by reference.

TECHNICAL FIELD

The invention relates to an apparatus arranged for feeding tubular elements inside drill holes. A purpose of the fed tubular elements is to provide support for drill hole openings against collapsing and for preventing drilling cuttings entering the previously drilled holes. The invention further relates to a rock drilling rig and method.

BACKGROUND

In mines, construction sites and at other work areas, different type of rock drilling rigs are used for drilling drill holes to rock surfaces. The rock drilling rigs are provided with one or more booms and rock drilling units are arranged at distal ends of the booms for drilling the drill holes. Typically, the drilled holes are charged by inserting explosive material inside them after all drill holes of a round have drilled. However, during drilling drilling cuttings are formed and the drilling cuttings may block openings of the already drilled holes and may otherwise hamper feeding of charges. Nowadays, tubular elements are mounted manually inside drill hole mouths for protecting the drill hole. The present solutions for feeding the tube elements are slow and require physical operator participation.

SUMMARY

An object of the invention is to provide an apparatus and method for inserting protective tube inserts inside drill hole openings. A further object is to provide a rock drilling rig implementing the mentioned apparatus and method.

In one embodiment, an apparatus for feeding a tubular object inside a drill hole includes a support device for supporting an elongated tube element blank having capacity for several successive tube inserts, a feeding device for moving a front end portion of the tube element blank longitudinally inside a drill hole for providing the drill hole with a protective section extending a limited longitudinal dimension towards a bottom of the drill hole, and a separation device for detaching the mentioned tube inserts one by one from the tube element blank.

In another embodiment, a rock drilling rig includes a movable carrier; at least one drilling boom; a drilling unit at a distal end part of the drilling boom, wherein the drilling unit includes a feed beam and a rock drilling machine supported movably on the feed beam; and an apparatus or feeding a tubular object inside a drill hole, wherein the tubular objects are tube inserts, which are separated at the drill hole from a tube element blank having capacity for several successive tube inserts, the apparatus being configured to insert the tube inserts to only cover mouth portions of the drill holes.

In yet another embodiment, a method of supporting mouth openings of drill holes includes inserting a tube insert partly inside the drill hole and extending the front end of the tube insert only a limited distance from the mouth of the drill hole; inserting the tube insert by means of an apparatus having a feeding device for moving the tube insert longitudinally; and detaching at the drill hole the tube insert from a tube element blank, which comprises material for several successive tube inserts.

An aspect of the disclosed solution is that an apparatus for feeding a tubular object partly inside a drill hole is introduced, as well as a rock drilling rig provided with the disclosed feed means. The apparatus includes a support device for supporting an elongated tube element blank comprising potential or capacity for several successive tube inserts. A front end of the tube element blank is moved longitudinally inside a drill hole by means of a feeding device. Thereby, the drill hole is provided with a protective section extending a limited longitudinal dimension towards a bottom of the drill hole. The apparatus further includes a separation device for detaching the mentioned tube inserts one by one from the tube element blank. The tube insert remains partly out of the drill hole.

An advantage of the disclosed solution is that use of the apparatus improves safety because the operator no longer needs to do manual mounting at the drilling site. The mounting process is also quickened as well as the entire drilling phase. Further, the feeding of the tube insert may be executed immediately after the drilling phase of the drill hole whereby the drill hole opening is being protected all the time.

A further advantage of the disclosed solution is that handling of the tube inserts is facilitated when a tube element blank is utilized instead of handling several separate tube inserts. The tube element blank in one single longitudinal entity which may be handled by means of simple and robust supporting and feeding means.

According to an embodiment, the separation device of the disclosed apparatus is configured to detach the distal tube insert after the front end portion of the tube element blank is inserted to the drill hole.

According to an embodiment, the tube element blank is not used as such for the supporting purposes but is divided into several separate pieces.

According to an embodiment, the separation device of the disclosed apparatus is configured to detach the tube insert from the front end portion of the tube element blank prior being fed to the drill hole by the feeding device.

According to an embodiment, the tube element blank comprises material for at least five successive tube inserts. However, the number of included successive tube inserts may be greater, for example 10-30.

According to an embodiment, the separation device of the disclosed apparatus is a cutting device which is configured to cut the tube insert with desired length from the tube element blank. In this embodiment tube inserts with desired length can be cut from the tube element blank having capacity for several successive tube inserts.

According to an embodiment, the mentioned tube element blank includes several pre-formed weakening portions, such as perforations, partial cuttings or grooves, whereby the tube element blank comprises several pre-designed tube insert or tube element sections, which may be separated one by one by means of the separation device. The separation device may be configured to direct a longitudinal force to an outermost tube insert or element section which will then be separated at the pre-designed weakened section. Due to the weakened section the separation may be done with reasonable force. Alternatively, the separation device directs transverse force to the outer most tube insert or element section in order to detach it. The weakened sections may have grooves on the outer surface of the tube element blank, or they may have several transverse through holes, for example. The apparatus may include suitable gripping elements, jaws and holding devices for transmitting the needed separation forces.

According to an embodiment, the tube element blank may have several preformed successive tube inserts or elements connected to each other by means of a coupling element or longitudinal coupling media, or alternatively the preformed inserts or elements may be arranged partly one inside another so that they form together the tube insert or element blank which can be handled in one piece. The separation device may direct a separation force to the outermost tube insert and may hold the second tube insert immovable, whereby the outermost tube insert is detached. When several separate tube inserts or elements are connected to each other, they form together one single piece which can be stored, fed and handled as one piece.

According to an embodiment, the tube element blank is made of bendable material and it may be relatively long. In order to handle such tube element blank the support device of the disclosed apparatus includes a rotating reel. The tube element blank may be stored in a wound state on the reel. The reel and the wound tube element blank takes only little space. The feeding device of the disclosed apparatus is configured to be unwind a desired length of the tube element blank from the reel. Let it be mentioned that the unwinding is also known as reeling out. The separation device may be a cutting device configured to cut the tube insert from the tube element blank.

According to an embodiment, the cutting device of the disclosed apparatus is a guillotine cutter. Operation of the guillotine type cutting device is based on at least one cutting blade movable in transverse direction relative to the tube element blank.

According to an embodiment, the operation of the cutting device of the disclosed apparatus is based on a rotating abrasive disc or by utilizing other chip removing machining solution, such as a circular saw blade.

According to an embodiment, the tube element blank is a hose.

According to an embodiment, the tube element blank is made of non-metallic material.

According to an embodiment, the tube element blank is made of resilient material.

According to an embodiment, the tube element blank is made of plastic material, rubber material or other lightweight material. A further alternative is to use fiber reinforced plastic material.

According to an embodiment, the tube element blank is a hydraulic or pneumatic hose. Hoses intended for pressure medium systems are bendable but still relatively sturdy so that their feeding to the drilled hole is easy.

According to an embodiment, the tube element blank is made of flexible or resilient material, or it has bendable structural configuration. In the latter case, the tube element blank may be a flexible steel pipe made of firm material but being provided with structure or design allowing bending.

According to an embodiment, the separation device is configured to detach tube inserts maximum lengths of which are 1000 mm. Thus, the mounted tube inserts cover the drill hole only partly.

According to an embodiment, the typical length of the tube insert is less than 500 mm.

According to an embodiment, the apparatus allows the length of the tube insert to be selected drill hole specifically. Then the operator or the control unit may select length of the insert tube or tube element case by case and may control the separation device accordingly. If there exists soil layers which may collapse, then greater length may be selected, and when the main purpose is to prevent drilling cuttings and other loose soil on the surface entering the drill hole, then use of shorter tube inserts or tube elements may be adequate.

According to an embodiment, the feeding device of the disclosed apparatus includes at least one pressure medium operated cylinder for generating longitudinal feed movement. Further, the apparatus comprises at least one gripping device which is located at the feeding device and is configured to grip the tube element blank or the detached tube insert. The gripping device may have jaws, grips, holding devices or other arrangements comprising movable support surfaces, for example.

According to an embodiment, the feeding device of the disclosed apparatus is configured to move a front end portion of an elongated tube element blank longitudinally partly inside a drill hole for providing the drill hole with a protective section for a longitudinally limited mouth portion of the drill hole.

According to an embodiment, the feeding device of the disclosed apparatus is configured to move a pre-detached tube insert partly inside the drill hole.

According to an embodiment, the support device of the disclosed apparatus comprises support elements for providing support for at least one tube element blank having rod-like configuration. The support elements may be mounted on a side of a feed beam, for example.

According to an embodiment, the disclosed rod-like tube element blank may be a continuous piece and the apparatus may include a cutting device for forming tube inserts with desired length. Alternatively, the rod-like tube element blank may be provided with several pre-formed weakened sections and the separation device is configured direct separation force to the blank for detaching the tube inserts.

According to an embodiment, the operation of the disclosed apparatus is controlled by means of at least one control unit. The control unit may have a processor for executing a computer program product designed for the purpose.

According to an embodiment, the disclosed apparatus is controlled automatically under control of the control unit.

According to an embodiment, the operation of the disclosed apparatus is semi-automatic. Then operation is controlled under co-operation between the operator and control unit.

According to an embodiment, the above mentioned control unit may control also the drilling boom or it may communicated with another control units controlling the drilling boom so that the apparatus may be moved at least between the drilling position and the tube insertion position.

According to an embodiment, the solution relates to a rock drilling rig intended for drilling drill holes to rock surfaces when implementing the drill and blast excavation method. The rig includes a movable carrier and one or more drilling booms. The drilling boom includes a drilling unit provided with a feed beam and a rock drilling machine supported movably on it. The rig further includes the disclosed apparatus for feeding tube inserts inside drill holes being drilled. The tube inserts are separated at the drill hole from a tube element blank having capacity or potential for several successive tubes inserts. The apparatus is configured to insert the mentioned tube inserts to only cover mouth portions of the drill holes.

According to an embodiment, the disclosed apparatus is mounted in connection with the drilling unit.

According to an embodiment, the disclosed apparatus is supported on the drilling unit so that it can be indexed on a drilling center for the duration of the feeding of the tube insert. Then the tube insert feeding may be executed without moving the drilling boom away from the drill hole just being drilled.

According to an embodiment, the disclosed apparatus may be supported fixedly on a side of the feed beam. Then the drilling unit is moved transversally after the drilling in order to positioning the apparatus at the mouth of the drill hole where after feeding of the tube insert may occur. Controlling movements of the drilling boom and the drilling unit may be executed automatically under control of a control unit. Thus, a so called data-controlling may be implemented.

According to an embodiment, the disclosed apparatus is mounted on a dedicated boom separate from the drilling boom.

According to an embodiment, the arrangement has one or more drilling booms executed drilling of several drill holes and a separate auxiliary boom equipped with the disclosed apparatus is configured to insert the tube inserts in a separate phase. Thus, the rock drilling rig may have dedicated booms for drilling and tube insertion.

According to an embodiment, the disclosed solution relates to a method of supporting mouth openings of drill holes. The method is arranged to insert relatively short tube elements or tube inserts partly inside the drilled holes. The method includes the following steps and features: inserting the tube insert by means of an apparatus comprising a feeding device for moving the tube insert longitudinally; and detaching at the drill hole the tube insert casing tube from a tube element blank, which comprises material for several successive tube inserts.

According to an embodiment, the disclosed method further includes handling and storing the tube element blank as one single piece or entity. According to an embodiment, the disclosed method may further include cutting from the tube element blank tube inserts with desired lengths.

According to an embodiment, the disclosed method may further comprise detaching the tube insert after a front end of the tube element blank is inserted inside the drill hole.

According to an embodiment, the disclosed method may include detaching the tube insert prior to the feeding measures.

According to an embodiment, the disclosed method may include using a bendable non-metallic tube as an elongated tube element blank. The tube element blank is cut into several individual tube inserts when arranging support for several drill holes of a drilling pattern.

According to an embodiment, the disclosed solution includes means, steps and control codes for collecting or picking up the used tube inserts after the charging or other finished drill hole measures have been done, and before the blasting of the round. The collected tube inserts may in some cases be re-used. The apparatus or the rock drilling unit may be provided with a grapping system or manipulator for collecting the tube inserts and tube insert storage. Alternatively, the collecting system may be arranged on a boom other than the drilling boom.

Further, below are disclosed some additional issues and features, which indicate that the disclosed tube inserts and their mounting process differ clearly from casing tubes used in oil and gas solutions. In the mentioned oil and gas industry several successive casing tubes connected to each other, extending from the mouth of the drill to the bottom, and being entirely inside the drill hole, are utilized.

The mounted tube insert extends longitudinal distance out of the drill hole after being mounted. The protruding tube insert prevents drilling cuttings, soil, water and other fluid material from flowing sideward and entering the drill hole. The outwards extending part of the insert rube or tube element forms an elevated edge or surface which can effectively protect the drill hole. Furthermore, the protruding part of the insert tube or tube element serves also as a physical visual mark improving finding of the mouth of the drill hole by an operator executing charging measures for the drill holes.

Both ends of the tube insert are free without any connecting elements and without being coupled to any other tube or other drill hole element.

The tube insert is without fastening means. Thus, the tube insert is not fastened to the rock surface, drill hole or any other physical object. In other words, the tube insert implements loose mounting principle since it is only inserted inside the mouth portion of the drill hole and it then keeps the position automatically utilizing friction, for example The length of the tube insert is shorter than the length of the drill hole, whereby the tube insert extends only a limited distance from the mouth of the drill hole towards the bottom of the drill hole. In other words, the tube insert covers only partly the drill hole.

The tube insert is without any connecting means, such as inner or outer coupling screw surfaces at its ends. This simply because the tube insert is not intended to be connected to any other tube inserts or components. In other words, the tube insert is a stand-alone component or an independent component.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
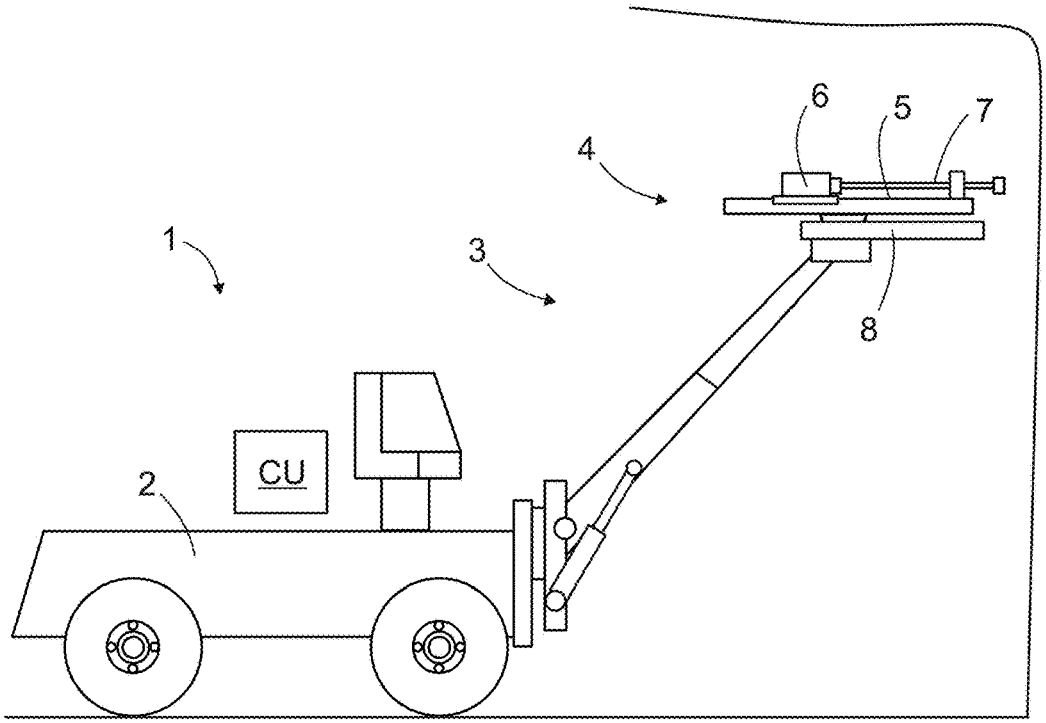
FIG. 1 is a schematic side view of a rock drilling rig provided with an apparatus for feeding tube inserts.

FIG. 1 shows a rock drilling rig 1. The rock drilling rig 1 includes a movable carrier 2 and at least one boom 3 connected to the carrier 2. At a distal end portion of the boom 3 is a drilling unit 4. The drilling unit 4 may include a feed beam 5 and a rock drilling machine 6 supported on it. The rock drilling machine 6 may include a rotating unit for rotating (R) a tool 7. The rock drilling machine may be of a top hammer type machine and may include an impact device for generating impact pulses for a drill bit of the tool. The rock drilling unit 4 may further include an apparatus 8 for feeding tube inserts to drill holes being drilled. The apparatus 8 may be capable of handling, supporting, storing, feeding and detaching material and objects relating to the tube inserts. These issues have been discussed already above and will be shortly discussed in connection with more detailed figures below.

Let it be further mentioned that operation of the rock drilling rig 1 and the related devices and apparatuses may be controlled under control of a control unit or in assistance with it.

Figure 2A:
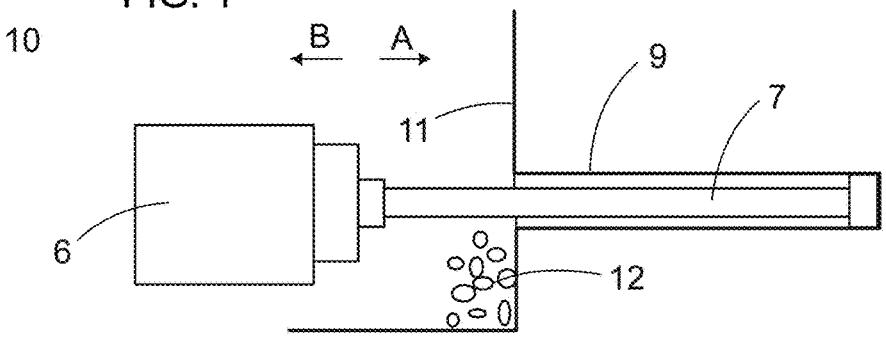
FIGS. 2*a*-2*c* are schematic views showing three successive phases relating to the present solution, and wherein the phases are drilling, tube insert feeding and charging of blast material.

FIG. 2*a* discloses that at first a drill hole 9 is drilled 10 to rock surface 11. During drilling rock material is removed and drilling cuttings 12 are flushed out of the drill hole 9. Drilling direction is indicated by a reference A and reverse directions as B.

Figure 2B:
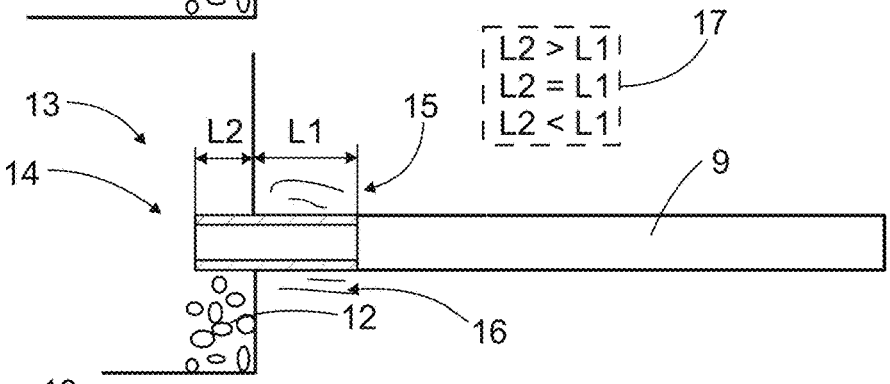

FIG. 2*b* discloses tube insertion 13 in which a tube insert 14 with relatively short length is inserted partly inside the drilled hole 9. The tube insert 14 covers a mouth portion or opening 15 of the drill hole 9. The rest of the drill hole 9 is with any tube inserts. As can be seen, the tube insert 14 prevents the drilling cuttings 12 entering the drill hole opening 15. Furthermore, the tube insert 14 may provide the drill hole opening 15 with support against collapse in case the rock material is loose or weak 16 at the upper portion of the drill hole 9. Part L2 of the tube insert 14 may remain outside the drill hole 9 and only part L1 is inserted inside the drill hole 9. The part L2 is typically longer than the inserted part L1. However, the situation may chose according to the need, as it is indicated by reference numeral 17.

Figure 2C:
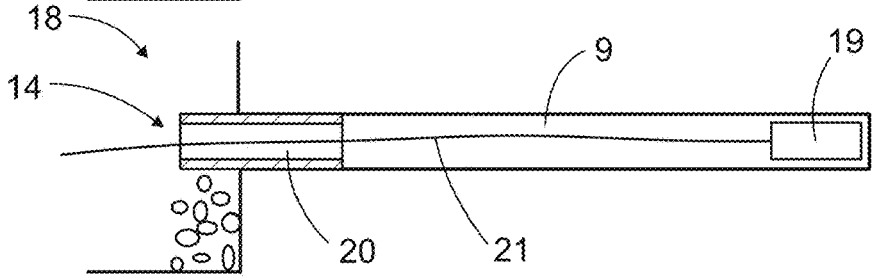

FIG. 2*c* discloses a charging phase 18 wherein explosive material or charges 19 are inserted to a bottom part of the drill hole 9 through a central opening 20 of the tube insert 14. A wiring 21 for blasting the charge 19 may be arranged via the opening 20.

Figure 3A:
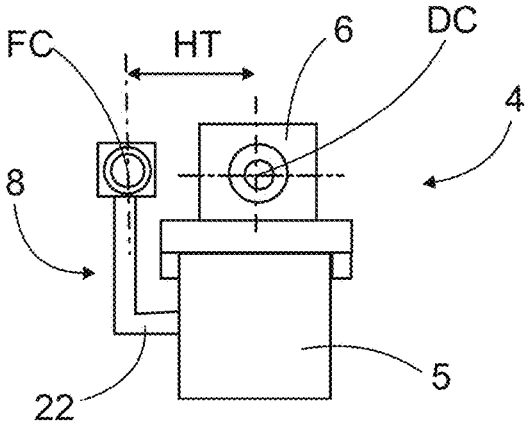
FIGS. 3*a*-3*c* are schematic views seen in a longitudinal direction of the drilling unit and showing three different possibilities to move the disclosed apparatus relative to a drilled hole.
Figure 3B:
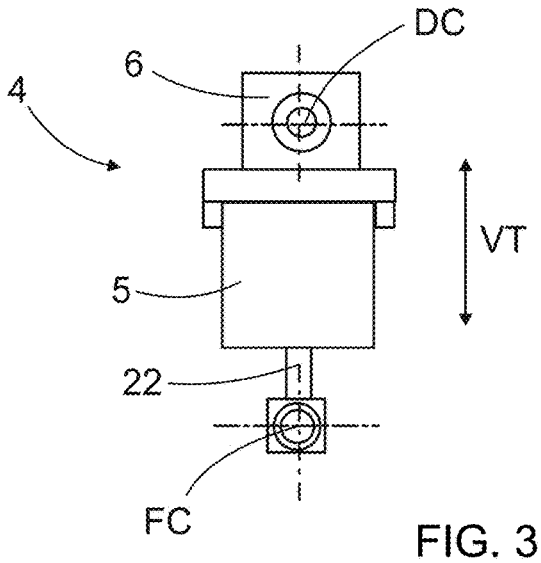
Figure 3C:
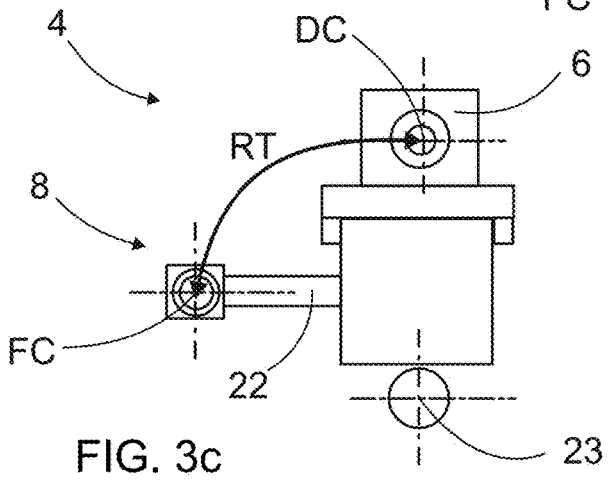

FIGS. 3*a*-3*c* show rock drilling units 4 which are all provided with feed beams 5, rock drilling machines 6 and also with apparatuses 8 for feeding tube inserts.

In FIG. 3*a* the apparatus 8 is mounted by means of support elements 22 on a side surface of the feed beam 5. After a drill hole have been drilled, a horizontal transfer HT is executed in order to move FC feed center of the apparatus 8 to the position of the initial drilling center DC allowing thereby feeding of tube insert inside the drill hole.

In FIG. 3*b* the apparatus 8 is mounted on opposite side of the feed beam 5 relative to the rock drilling machine and the feed center FC is moved by means of a vertical transfer VT to the position of the drilling center DC.

In FIG. 3*c* a rotation transfer RT is utilized for moving the apparatus 8 at the drill hole. The rock drilling unit 4 may include turning arrangement comprising a turning actuator configured to turn the system relative to a turning joint 23.

Figure 4A:
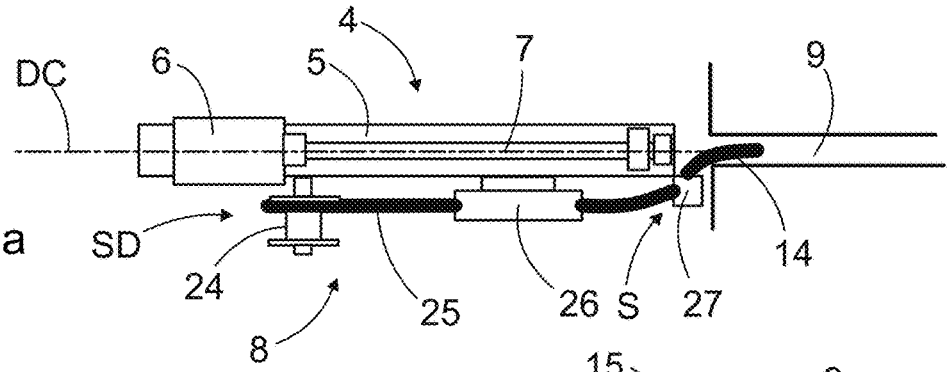
FIG. 4*a* is a schematic side top of a rock drilling unit and a side mounted apparatus for feeding tube inserts.

FIG. 4*a* discloses a rock drilling unit 4 and a side mounted apparatus 8 for feeding tube inserts 14. The apparatus 8 includes a reel 24 for storing and handling a flexible tube element blank 25, which may be fed by means of feeding device 26 to a drill hole 9. At the front end portion of the feed beam 5 may be a cutting device 27 for separating the tube insert 14 from the rest of the tube element blank 25. In the disclosed solution the drilling unit 4 needs not to be transferred after the drilling away from the drilling center DC but instead the tube insertion may be executed from the side. The drilling unit 4 may be reversed for a distance in order to facilitate the tube insertion process.

Figure 4B:
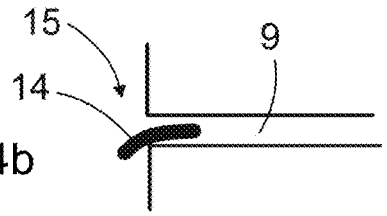
FIG. 4*b* is a schematic side view showing a drill hole opening provided with a hose-like tube insert.

FIG. 4*b* discloses a drill hole opening 15 provided with a hose-like tube insert 14. The tube insert 14 may be pressure medium hose having a desired length.

Figure 5:
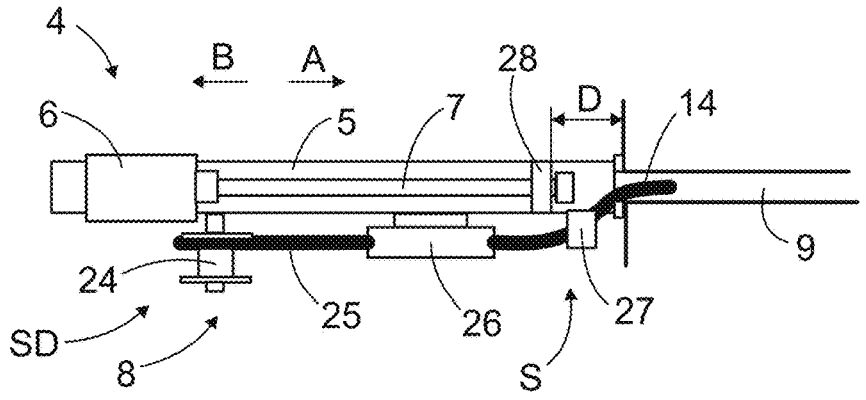
FIG. 5 is a schematic top view of an alternative rock drilling unit and arrangement for feeding tube inserts.

FIG. 5 discloses an alternative rock drilling unit 4 compared to one shown in FIG. 4*a*. In this solution the drilling unit 4 includes a front tool support 28 at a distance D from a front most end of the feed beam 5. Then the drilling tool 7 may be reversed in direction B for facilitating the tube insert 14 feeding.

Figure 6:
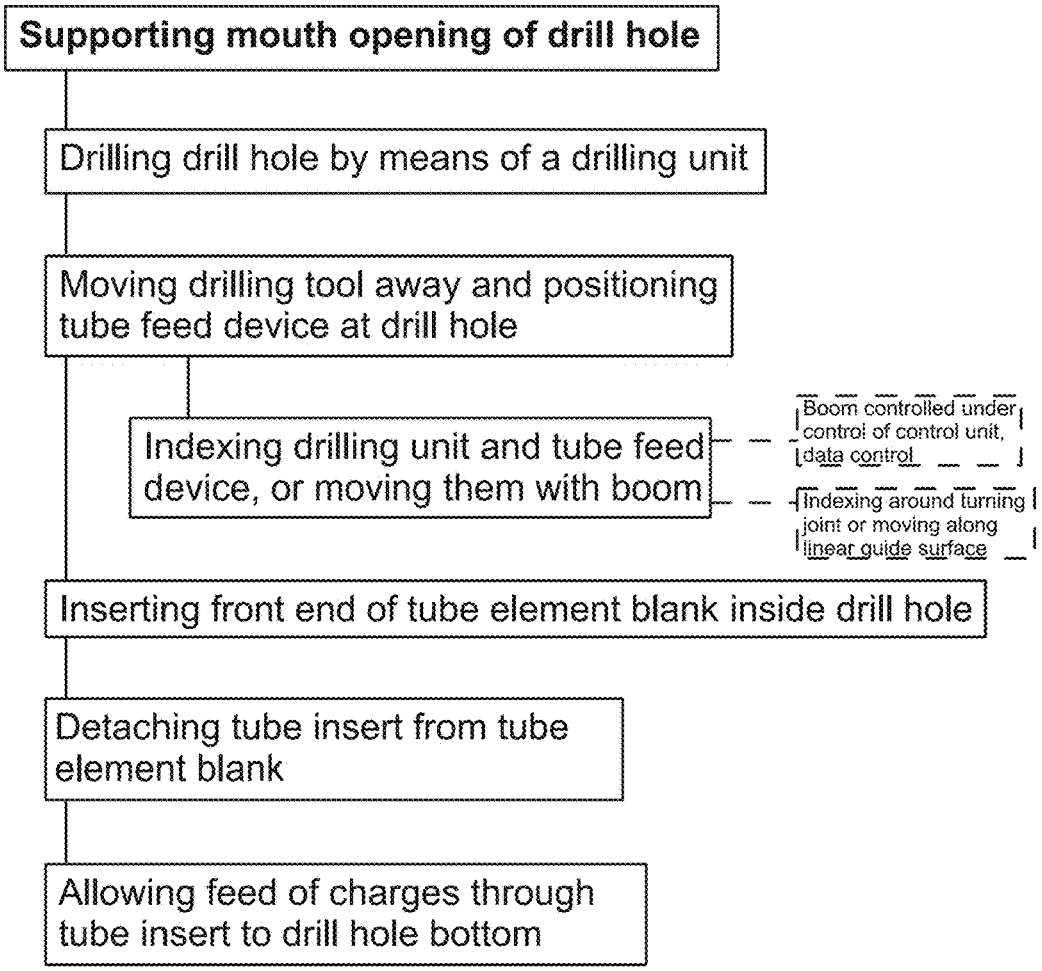
FIG. 6 is a diagram showing some principles of supporting drill hole openings.

FIG. 6 discloses some principles of supporting drill hole openings. The disclosed issues have been discussed already above in this document.

Figure 7:
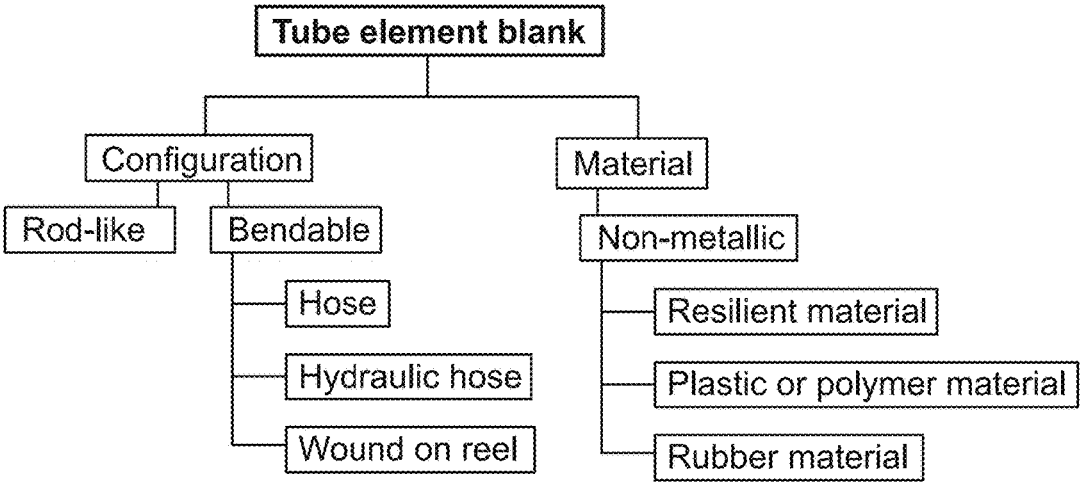
FIG. 7 is a diagram showing some features of a tube element blank.

FIG. 7 discloses some features of a tube element blank. As can be noted, there are several alternatives to be implemented.

Figure 8:
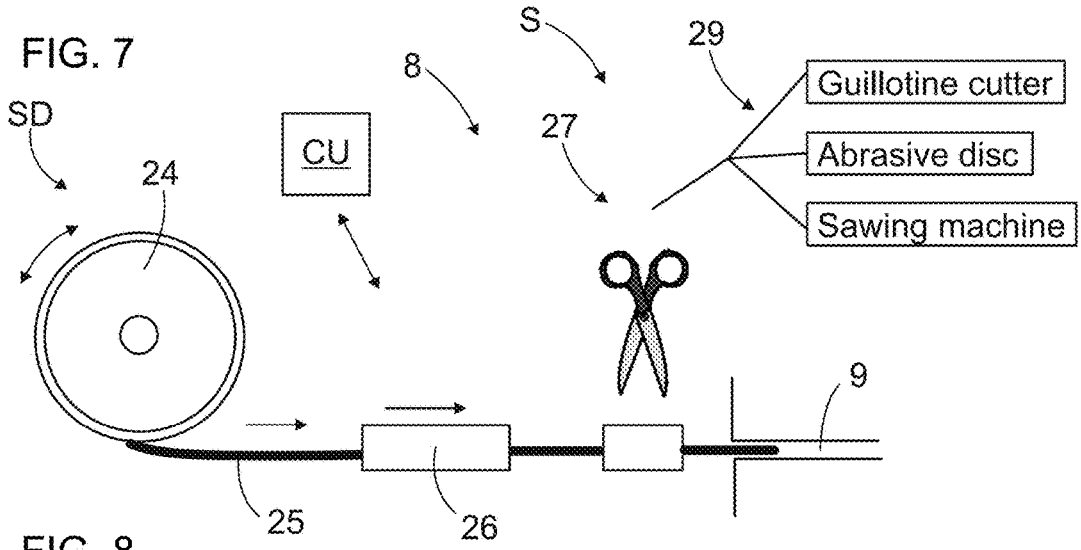
FIG. 8 is a schematic view of an arrangement, wherein tube inserts are being cut from a continuous uniform tube element blank.

FIG. 8 discloses an apparatus 8 wherein tube inserts are being cut from a continuous uniform tube element blank 25 by means of a cutting device 27. Several alternative cutting principles 29 are also introduced.

In FIGS. 4*a*, 5 and 8 the cutting device 27 is utilized as a separation device S.

Figure 9:
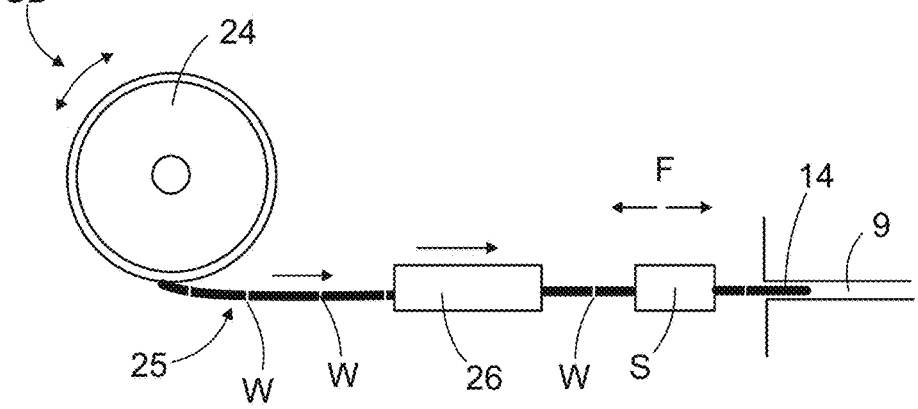
FIG. 9 is a schematic view of an arrangement, wherein tube inserts are separated from a continuous uniform tube element blank by subjecting longitudinal force effect on the first tube insert.

FIG. 9 discloses an apparatus 8, which includes a different type separation device S. In this solution tube inserts 14 are separated from a continuous uniform tube element blank 25 by subjecting longitudinal force effect F on the first tube insert. The tube element blank 25 includes weakening sections W for defining the separation points.

Figure 10:
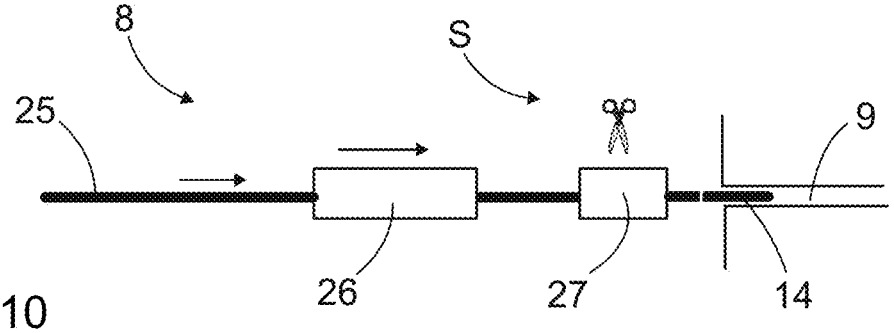
FIG. 10 is a schematic view of an arrangement, wherein tube inserts are being cut from a rod-like tube element blank.

FIG. 10 discloses an apparatus 8, which is configured to cut or share tube inserts 14 from a rod-like tube element blank 25.

Figure 11:
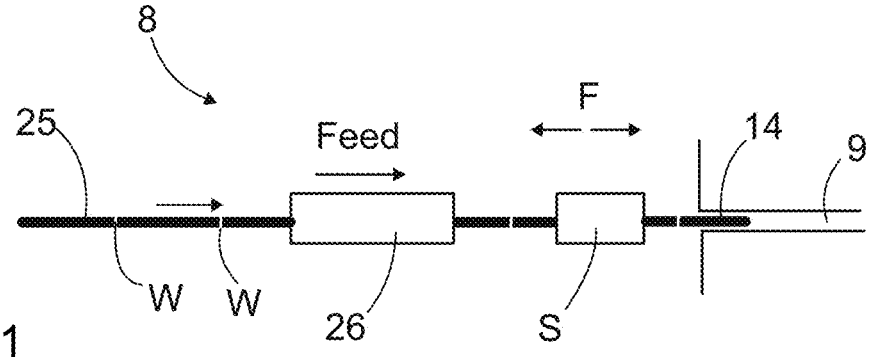
FIG. 11 is a schematic view of an arrangement, wherein tube inserts are separated from a rod-like tube element blank by subjecting longitudinal force effect on the first tube insert.

FIG. 11 discloses an apparatus 8, which is configured to separate tube inserts 14 at weakened portion W from a rod-like tube element blank 25. The separation device subjects longitudinal force effect on the first tube insert 14.

Figure 12:
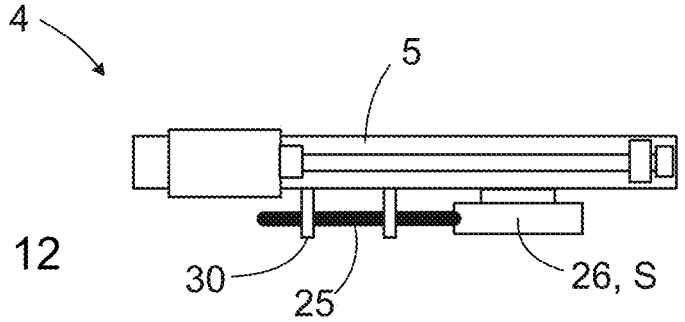
FIG. 12 is a schematic top view of an arrangement wherein a support system of the disclosed apparatus is mounted on a side of a rock drilling unit in order to provide support for a rod-like tube element blank.

FIG. 12 discloses an apparatus 8 comprising a support system or device SD, which may include two or more support protrusions 30 mounted on a side of a feed beam 5 in order to provide support for a rod-like tube element blank 25. Other type of support devices, such as grips and hold arms, may also be implemented.

Figure 13:
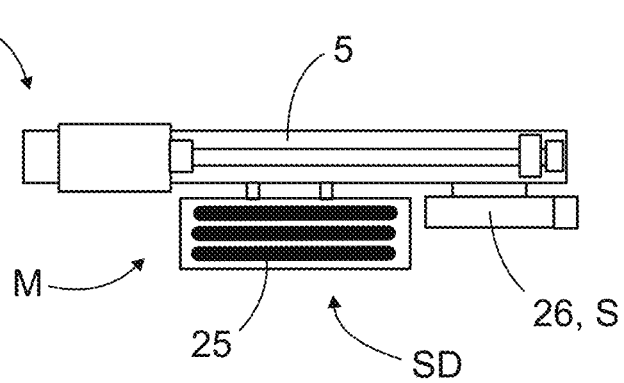
FIG. 13 is a schematic top view of an arrangement wherein a magazine is mounted on a side of a rock drilling unit in order to provide support for several rod-like tube element blanks.

FIG. 13 discloses that an apparatus 8 may be provided with a magazine M in order to store and to provide support for several rod-like tube element blanks 25.

Let it be mentioned that in FIGS. 4*a*, 5, 7 and 8 the reel 24 may serve as a support device SD.

Figure 14:
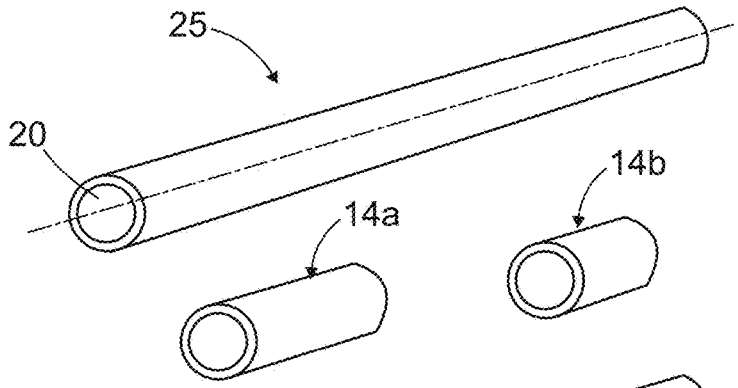
FIG. 14 is a schematic view of an elongated rod-like tube element blank comprising potential for several tube inserts, which are removable by cutting means.

FIG. 14 discloses an elongated rod-like tube element blank 25 with potential for several tube inserts 14. Tube inserts 14*a*, 14*b* with different lengths may be cut, as is demonstrated.

Figure 15:
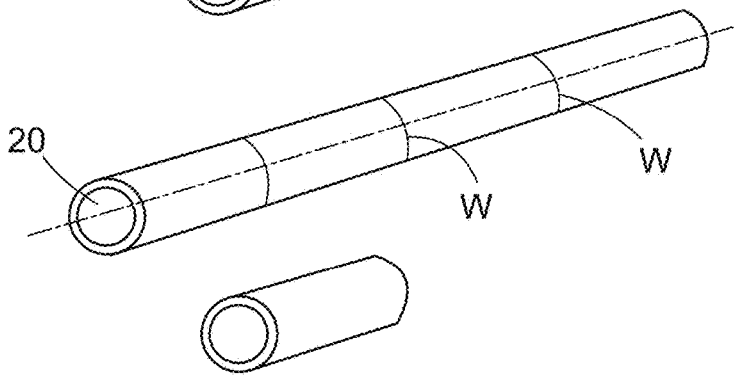
FIG. 15 is a schematic view of an elongated rod-like tube element blank comprising potential for several tube inserts, which are separable from each other at pre-determined separation locations.

FIG. 15 discloses an elongated rod-like tube element blank 25 comprising potential for several tube inserts 14, which are separable from each other at pre-determined separation locations or weakened sections W.

Figure 16:
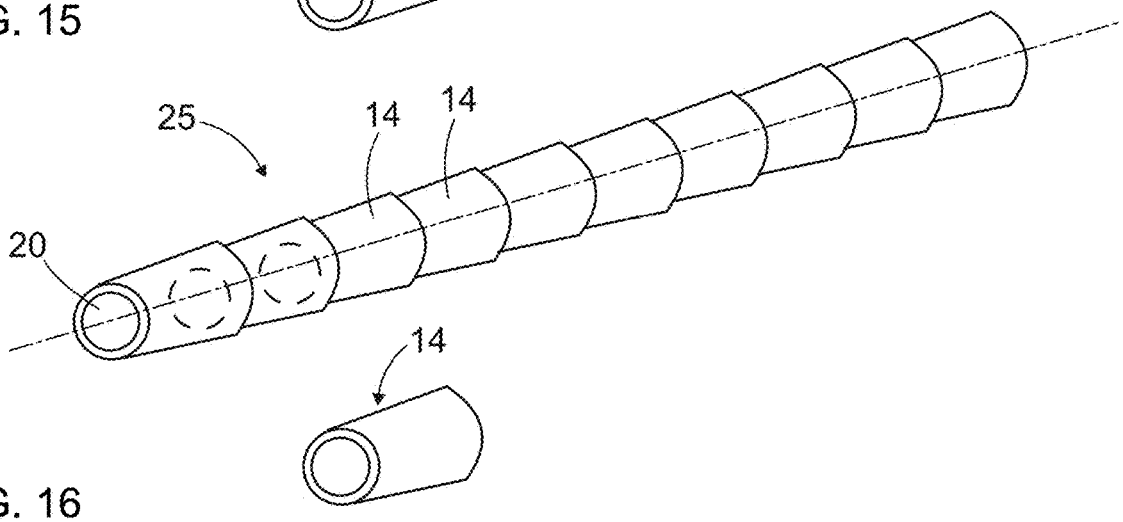
FIG. 16 is a schematic view of an elongated tube element blank comprising several pre-formed tube inserts having conical shape and wherein the separate tube inserts are connected to each other and successive tube inserts are arranged partly inside each other.

FIG. 16 discloses an elongated tube element blank 25 including several pre-formed tube inserts 14 having conical shape and wherein the separate tube inserts 14 are connected to each other by means of their structure or shape. Then successive tube inserts 14 may be arranged partly inside each other.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. An apparatus arranged for feeding at least one tubular insert inside a drill hole, the apparatus comprising:

a support device arranged for supporting an elongated tube element blank, the tube element blank having capacity for supporting a plurality of successive tube inserts;

a feeding device arranged for moving a front end portion of the tube element blank longitudinally inside drill hole for providing the drill hole with a protective section extending a limited longitudinal dimension towards a bottom of the drill hole, wherein the feeding device includes at least one pressure medium operated cylinder arranged for generating longitudinal feed movement; and a separation device arranged for detaching the tube inserts one by one from the tube element blank, wherein the separation device is a cutting device arranged at a front end portion of a feed beam arranged at a drilling unit positionable at the drill hole, the cutting device being configured to cut the tube insert with a desired length from the tube element blank, wherein the apparatus is arranged at a side of the drilling unit such that the inserts are inserted from the side of the drilling unit.

2. The apparatus as claimed in claim 1, wherein the tube element blank is made of bendable material.

3. The apparatus as claimed in claim 1, wherein the tube element blank is made of non-metallic material.

4. The apparatus as claimed in claim 1, wherein the separation device is configured to detach tube inserts maximum lengths of which are 1000 mm.

5. The apparatus as claimed in claim 1, wherein the support device includes support elements arranged for providing support for at least one tube element blank having a rod-like configuration.

6. The apparatus as claimed in claim 1, wherein operation of the apparatus is controlled automatically by means of at least one control unit.

7. A rock drilling rig comprising:

a movable carrier;

at least one drilling boom;

a drilling unit disposed at a distal end part of the drilling boom, wherein the drilling unit includes a feed beam and a rock drilling machine supported movably on the feed beam; and an apparatus for feeding a plurality of tubular objects inside a drill hole according to claim 1, wherein the plurality of tubular objects are tube inserts which are separated at the drill hole from a tube element blank having capacity for supporting several successive tube inserts, the tube inserts being arranged to only cover mouth portions of the drill holes.

8. The rock drilling rig as claimed in claim 7, wherein the apparatus is connected to the drilling unit.

9. The rock drilling rig as claimed in claim 7, wherein the apparatus is mounted on a dedicated boom separate from the drilling boom.

10. The apparatus as claimed in claim 1, wherein support device includes a rotating reel on which reel the tube element blank is stored in a wound state.

11. The apparatus as claimed in claim 10, wherein the feeding device is configured to reel out a desired length of the tube element blank from the reel.

12. The apparatus as claimed in claim 1, further comprising at least one gripping device located at the feeding device and configured to grip the tube element blank or the detached tube inserts.

13. A method of supporting mouth openings of drill holes, wherein the method comprises:

inserting a tube insert partly inside a drill hole and extending a front end of the tube insert only a limited distance from the mouth of the drill hole;

inserting the tube insert by means of an apparatus including a feeding device for moving the tube insert longitudinally; and detaching at the drill hole the tube insert from a tube element blank, which includes material for several successive tube inserts with a separation device arranged at a front end portion of a feed beam arranged at a drilling unit positionable at the drill hole, wherein the apparatus is arranged at a side of the drilling unit such that the inserts are inserted into the drill hole from the side of the drilling unit, wherein the tube insert is detached after a front end of the tube element blank is inserted inside the drill hole.

14. The method as claimed in claim 13, further comprising cutting from the tube element blank tube inserts with desired lengths.

15. The method as claimed in claim 13, further comprising cutting the tube element blank into several individual tube inserts when arranging support for several drill holes of a drilling pattern.

* * * * *